United States Patent [19]

Johnson

[11] 4,066,243

[45] Jan. 3, 1978

[54] VEHICLE BODY PART HOLDING AND POSITIONING DEVICE

[76] Inventor: Edmond L. Johnson, 21944 Elroy, Warren, Mich. 48089

[21] Appl. No.: 788,748

[22] Filed: Apr. 19, 1977

[51] Int. Cl.[2] ..... B66F 3/00

[52] U.S. Cl. ..... 254/133 R

[58] Field of Search ..... 254/133, 134, DIG. 1, 254/100; 269/17

[56] References Cited

U.S. PATENT DOCUMENTS

| | | | |
|---|---|---|---|
| 2,164,621 | 7/1939 | Pfauser | 254/133 |
| 2,327,180 | 8/1943 | Diercksmeier | 254/133 |
| 2,852,229 | 9/1958 | Gross | 254/134 |
| 3,073,570 | 1/1963 | Harvey | 254/134 |
| 3,834,669 | 9/1974 | Reid | 254/133 |

*Primary Examiner*—Robert C. Watson
*Attorney, Agent, or Firm*—William L. Fisher

[57] ABSTRACT

A vehicle body part holding and positioning device comprising a floor supported rollable frame, a pair of side by side pipes supported in an upright position on the frame, a second pair of pipes lengthwise joined together, the second pair of pipes encircling the first-mentioned pair of pipes and being vertically slideable thereon, a pair of widthwise spaced apart arms for holding and cradling thereon a vehicle body part, the arms held fast to the second pair of pipes for movement therewith, the arms disposed over the frame so that the center of weight of the vehicle body part coincides with the center of length of the frame, an arrangment on the frame for engaging the foot end of a friction jack, an eye on the second pipes for engaging the moveable head of the jack, whereby the jack can be operated to lift the vehicle body part above the frame, and pins for holding the second pipes elevated on the first pipes without the use of the friction jack, whereby the device can be rolled to hold and position the vehicle body part in respect to a vehicle body during assembly or disassembly thereof.

4 Claims, 6 Drawing Figures

VEHICLE BODY PART HOLDING AND POSITIONING DEVICE

My invention relates to vehicle body repair.

The principal object of my invention is the provision of improvements pertaining to a vehicle body part holding and positioning device for use in vehicle body repair which renders said device compact and economical to manufacture and efficient, whereby to facilitate the repair of vehicle bodies.

Figure 3:
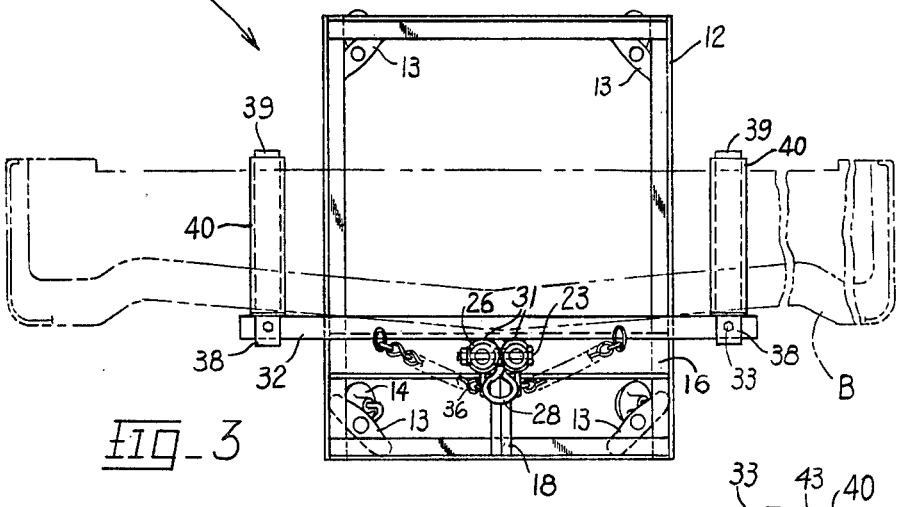
Figure 6:
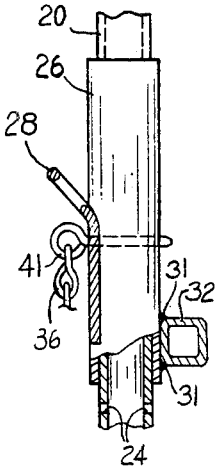
Figure 5:
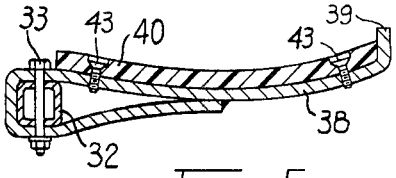
Figure 1:
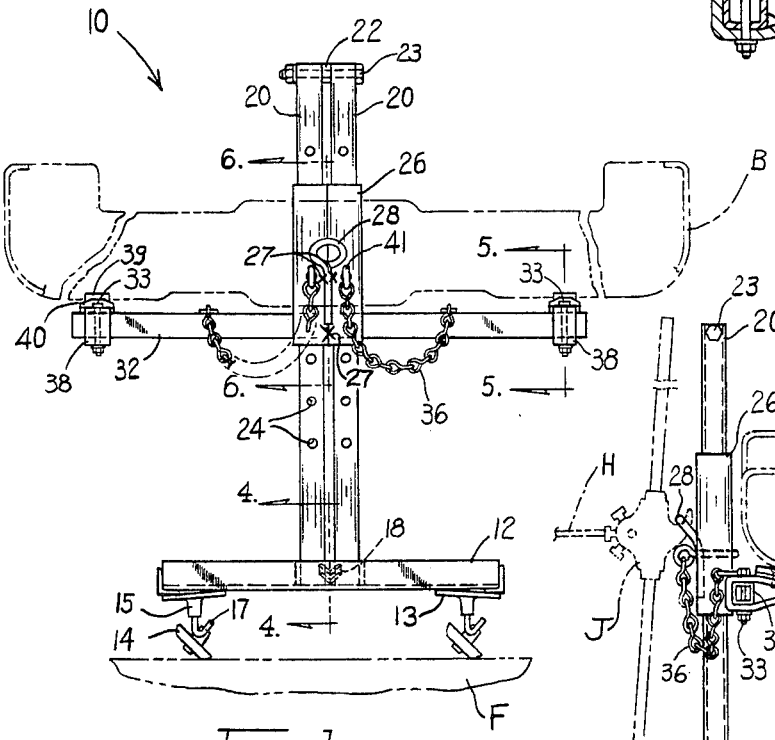
Figure 2:
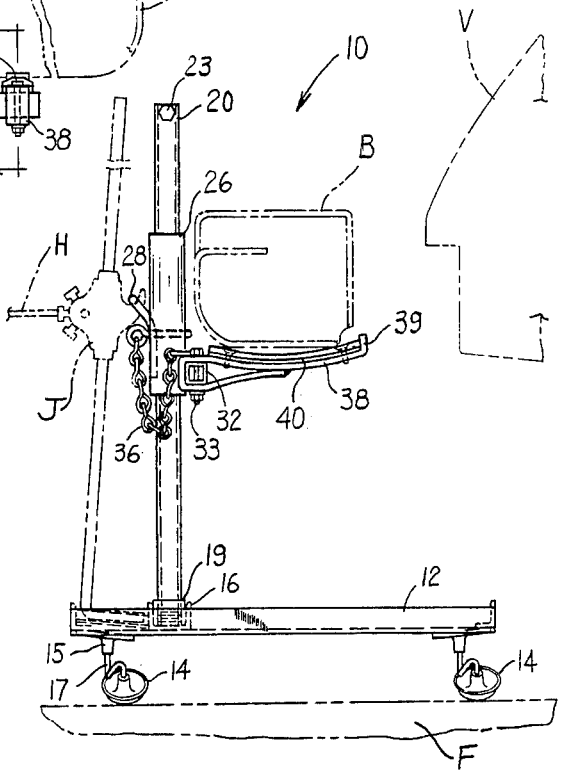
Figure 4:
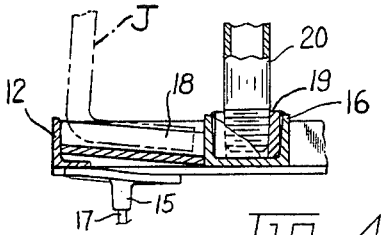

The foregoing object of my invention and the advantages thereof will become apparent during the course of the following description, taken in conjunction with the accompanying drawings, in which:

FIGS. 1–3 are, respectively, front and side elevational and top plan views of a lift device embodying my invention; and FIGS. 4–6 are vertical sectional views of the structure of FIG. 1 taken, respectively, on the lines 4—4, 5—5, and 6—6 thereof.

Referring to the drawings in greater detail, 10 generally designates said embodiment which comprise an angle iron frame 12 having a channel iron cross-piece 16 near the front end thereof. Extending lengthwise of the frame 12 is an angle iron member 18 fastened between said cross-piece 16 and the front of the frame 12. Said member 18 slants downwardly as it extends rearwardly and is disposed so that it forms an upwardly facing V-shaped trough. The frame 12 is rollably supported on the floor F by casters 14 of the swingable axle type. Said casters 14 are secured at the four corners of the frame 12 by members 13, 15 and 17. A pair of upright pipes 20 are supported on the cross-piece 16 and vertically slidably carry another pair of pipes 26. Said pipes 26 are lengthwise joined together by welding. An eye member 28 is welded to the pipes 26 at the junction line on the front side thereof. The welding of the pipes 26 together and the welding of the eye member 28 to the front side of the pipes 26 is indicated at 27. In the instance, the pipes 20 are threaded into pipe caps 19 at their lower ends and removeably fastened together at their upper ends by a spacer 22 and fastener 23. A cross-piece support member 32 in the form of square tubing is welded, as at 31, to the pipes 26 on the rear side thereof and extends widthwise of the base 12 beyond the confines thereof. A pair of arms 38 are fastened, as at 33, to the member 32 at the outer ends thereof. The arms 38 are formed upwardly concave over their lengths and have their free ends upturned, as at 39. The arcuately formed portions of the arms 38 have rubber pads 40 fastened thereto as by fasteners 43. A pair of chains 36 are welded to the member 32 and carry respective pins 41 on the free ends thereof. The pair of pins 41 are insertable through a pair of apertures in the pipes 26 and through one of a number of pairs of vertically spaced apart apertures 24 in the pipes 20. The pins 41 serve as a safety means to hold the pipes 26 and hence the arms 38 in whatever position to which they are elevated.

Said device 10 operates in conjunction with a friction jack J to lift a vehicle body part in respect to the frame 12 and hold it elevated while it is being assembled or disassembled in respect to a vehicle body. Said jack J includes a head which, via internal gears (not shown), forcefully moves up and down the elongated part of an L-shaped support bar upon manual actuation of a handle H. Said handle H is insertable into one or more openings on the front side of the head, as shown in FIG. 2, for actuating the gears in the head of the jack J. The foot end of the support bar is cradled in the V-shaped trough of the member 18 and a hook on the rear side of said head engages the eye on the member 28 for lifting or lowering the pipes 26, cross-piece 32, arms 38 and whatever load is placed on the latter. The arms 38 are constructed to cradle and hold a vehicle body part, such as a bumper B, which is to be assembled or disassembled in respect to a vehicle body as shown and indicated at V in FIG. 2. The center of weight of the load on the arms 38 is arranged to coincide with the center of the length of the frame 12 by reason of the off-center disposition of the frame cross-piece 16. In assembly of the bumper B to the vehicle body, the device 10 is rolled into position and the bumper B is elevated by operation of the jack J to the height required and the pair of apertures in the pipes 26 are aligned with a pair of the apertures 24 in the pipes 20. The pins 41 may then be inserted into the pipes 26 and 20 to hold the bumper B elevated without further need of the jack J. Thereafter the friction jack J can be removed from the device 10. FIG. 2 shows the condition of the device 10 prior to removal of the friction jack J therefrom. Vehicle body repairmen are usually paid on piece work and hence it is highly desirable for a repairman to be able to assemble or disassemble vehicle body parts in respect to vehicle bodies without asking a co-worker repairman to assist him. With my device 10 I can assemble or disassemble all kinds of vehicle body parts, such as bumpers and doors, in respect to vehicle bodies all by myself without help from anyone else and can do the job faster and with less effort and without imposing on another in contrast to working without said device 10 and having another repairman assist me. Said device 10 also functions as a vertically moveable table for conveniently holding a body part for a repairman to work on such as disassembling salvage parts from a damaged body part or assembling salvaged parts to a new body part.

It will thus be seen that there has been provided by my invention improvements pertaining to a vehicle body part holding and positioning device in which the object hereinabove set forth, together with many thoroughly practical advantages, has been successfully achieved. For example, my device 10 uses a separate friction jack as the power source for lifting which, alone, diminishes the complexity of my device 10. Also, by virtue of the fact that the pipes 20 can be removed from the frame 12 and from the pipes 26, my device 10 can be easily dismantled for shipment or storage. While a preferred embodiment of my invention has been shown and described, it is to be understood that variations and changes may be restorted to without departing from the spirit of my invention as defined by the appended claims.

I claim:

1. A vehicle body part holding and positioning device comprising a floor supported rollable frame, a pair of side by side pipes supported in an upright position on said frame, a second pair of pipes lengthwise joined together, said second pair of pipes encircling said first-mentioned pair of pipes and being vertically slideable thereon, a pair of widthwise spaced apart arms for holding and cradling thereon a vehicle body part, means holding said arms fast to said second pair of pipes for movement therewith, said holding means disposing said arms over said frame so that the center of weight of said vehicle body part coincides with the center of length of said frame, means on said frame for engaging the foot end of a friction jack, means on said second pipes for engaging the moveable head of said jack, whereby the jack can be operated to lift said vehicle body part above said frame, and means for holding said second pipes elevated on said first pipes without the use of said friction jack, whereby the device can be rolled to hold and position said vehicle body in respect to a vehicle body during assembly or disassembly thereof.

2. A vehicle body part holding and positioning device comprising a four sided rectangular frame, a cross-piece frame member for said frame, a pair of side by side pipes supported in an upright position on said frame member, a second pair of pipes lengthwise joined together, said second pair of pipes encircling said first-mentioned pair of pipes and being vertically slideable thereon, a cross piece joined to said second pair of pipes so as to be moveable therewith, a pair of widthwise spaced apart arms fast to said cross piece for holding and cradling thereon a vehicle body part, said cross piece disposing said arms over said frame so that the center of weight of said vehicle body part coincides with the center of length of said frame, a V-shaped trough on said frame for engaging the foot end of a friction jack, an eye fast to said second pipes for engaging the moveable head of said jack, said frame having swingable axle type casters so as to be rollably supported on a floor, whereby the jack can be operated to lift said vehicle body part above said frame, and a pair of pins and spaced apart aperatures in said first-mentioned pipes for holding said second pipes elevated on said first pipes without the use of said friction jack, whereby the device can be rolled to hold and position said vehicle body part in respect to a vehicle body during assembly or disassembly thereof.

3. A vehicle body part holding and positioning device as claimed in claim 2, said arms being upwardly concave over their lengths and having their free ends upturned to enhance the holding and cradling thereon of said vehicle body part.

4. A vehicle body part holding and positioning device as claimed in claim 2, said V-shaped trough being disposed at an angle to the horizantal to enhance the engagement of said friction jack with said device.

* * * * *